United States Patent [19]

Welke

[11] 4,016,604

[45] Apr. 12, 1977

[54] STERILE BACK SURGICAL GOWN WITH ANCHORED BELT POUCH

[75] Inventor: Karen E. Welke, Roseville, Minn.

[73] Assignee: Will Ross, Inc., Milwaukee, Wis.

[22] Filed: May 24, 1976

[21] Appl. No.: 689,194

[52] U.S. Cl. ..... 2/51; 2/DIG. 7

[51] Int. Cl.[2] ..... A41D 13/00

[58] Field of Search ..... 2/114, DIG. 7, 51; 206/278, 439, 440

[56] References Cited

UNITED STATES PATENTS

| | | | |
|---|---|---|---|
| 3,594,818 | 7/1971 | Planner | 2/114 |
| 3,696,443 | 10/1972 | Taylor | 2/114 |
| 3,843,971 | 10/1974 | Delanty et al. | 2/114 |

*Primary Examiner*—Werner H. Schroeder
*Assistant Examiner*—Moshe I. Cohen
*Attorney, Agent, or Firm*—Quarles & Brady

[57] ABSTRACT

A sterile back surgical gown has a back closure panel that is initially folded in an open position and that is unfolded to a closed position where it overlaps the back of the gown. A back belt at the free end of the closure panel is stored in a pocket and has a free end enclosed in a protective pouch. The pouch extends across and is releasably anchored to the adjacent gown material so that the pouch serves as a holding means to releasably hold the closure panel in open position and also securely anchors the free end of the belt.

5 Claims, 6 Drawing Figures

Fig. 3
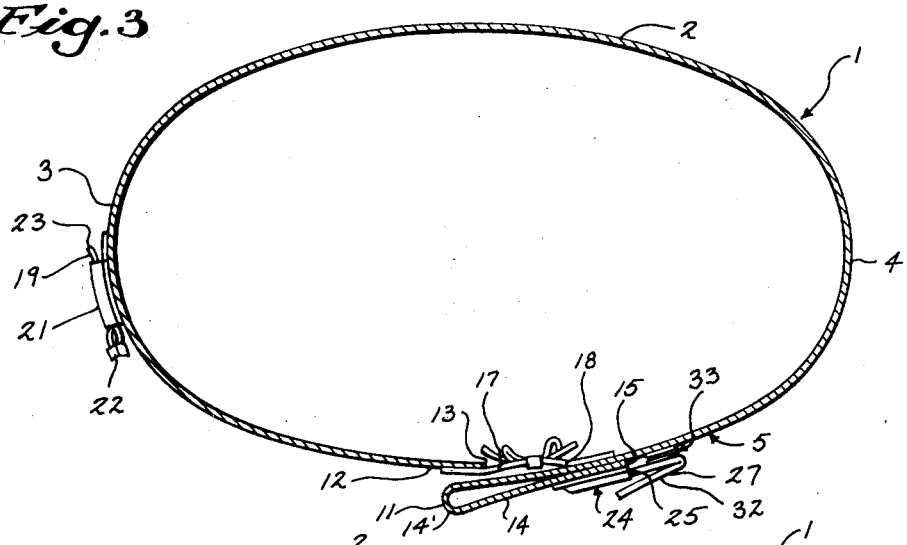
Fig. 4
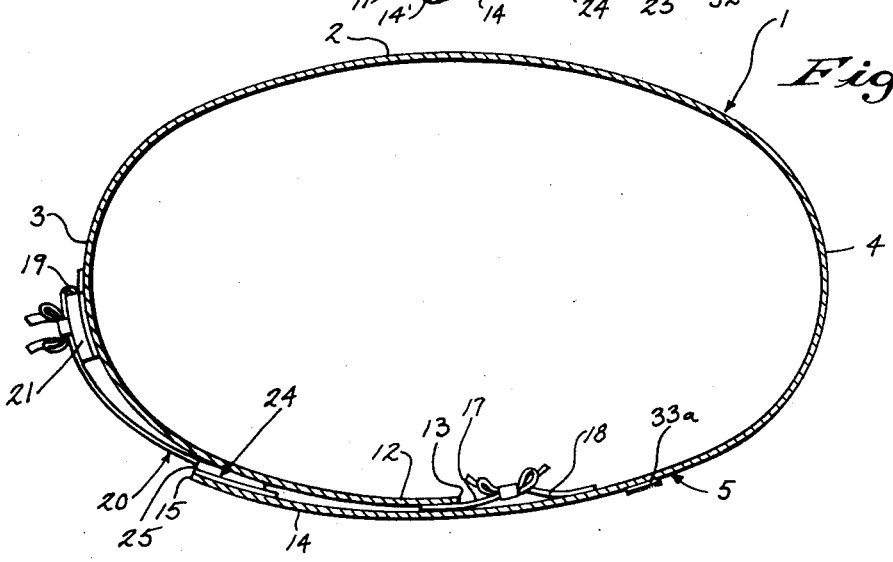
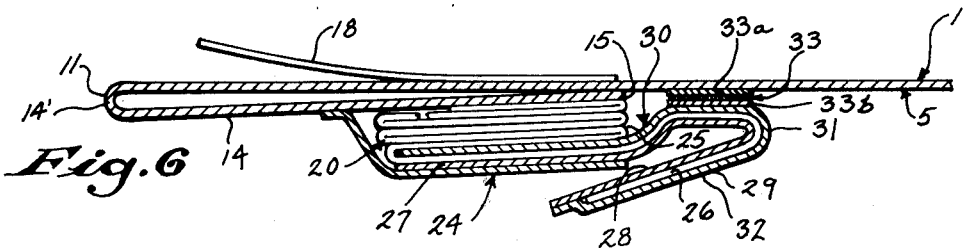
Fig. 6
Fig. 5
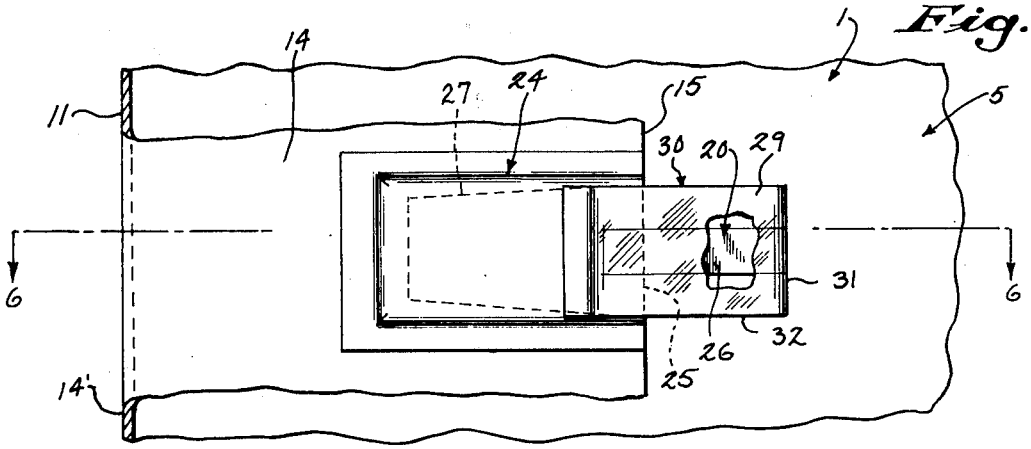

STERILE BACK SURGICAL GOWN WITH ANCHORED BELT POUCH

BACKGROUND OF THE INVENTION

This invention relates but is not necessarily limited to back opening, sterile back surgical gowns of the type shown in the copending applications of Phyllis J. Horan, Ser. No. 644,046 filed Dec. 24, 1975 for "Side Belted Surgical Gown and the Like" and the copending application of Robert J. Horan, Ser. No. 644,045 filed Dec. 24, 1975, now U.S. Pat. No. 3,977,025, for "Belt Closure for Sterile Back Surgical Gown and the Like" to which reference may be had.

Sterile back gowns generally have an inner back panel and an outer back closure panel that is initially folded back on itself so that what will ultimately be the outer surface is protected during donning. After the gown is donned, the closure panel is unfolded, so that it overlaps the inner panel and extends toward one side of the gown, and then secured. This type of gown is generally very satisfactory, but it is difficult to provide simple means for maintaining the closure panel in an open position while the gown is being donned to avoid accidental contamination and to provide a suitable closure for securing the closure panel quickly and properly without loss of sterility.

The Horan applications mentioned above show sterile back gowns with belt closures, which are desirable because of their simplicity and strength and because they make it easy to adjust the size of the gown to the wearer. The closures include a back belt member that is stored in a pocket on the closure panel and has its free end in a protective pouch that extends partially into the pocket and is deadfolded so that a non-sterile assistant can grasp the pouch and belt end and pass it to the wearer, who grasps the belt behind the pouch whereupon the assistant simply slides the pouch off the belt leaving the wearer with a completely sterile belt. The inner end of the belt is anchored to one part of a snap or other pressure sensitive holding means that holds the closure panel open, and pulling on the belt after it is removed from the pocket causes the holding means to release so that closure panel can be unfolded to closed position.

The arrangement described is very satisfactory, but pulling on the belt to release the holding means can result in excessive strain on the material, which is particularly undesirable in disposable gowns where the material does not have all the physical strength of the cloth from which reusable gowns are made. Further, the technique requires that the belt be withdrawn completely from the pocket and then pulled in a direction generally away from the back of the wearer, and this can be inconvenient, particularly with long belts or where there is limited space for movement or other personnel nearby. Still further, the pouch can fall or be accidentally dislodged from the pocket.

SUMMARY OF THE INVENTION

It is the general object of this invention to provide an improved back belt arrangement in which the protective pouch for the belt end is releasably anchored to the adjacent gown materials so that the belt is securely anchored and the pouch also serves as a holding means to hold the closure panel open during the initial donning steps. An assistant can release the holding means by grasping the pouch and pulling it a short distance away from the gown, whereupon the assistant withdraws the belt and passes it to the wearer as noted above.

In the preferred embodiment, the pouch is deadfolded to provide a tab that is easy to grasp without danger of destroying the sterility of the adjacent gown area, and the exposed side of the tab portion of the pouch is transparent so that the assistant can be sure of grasping the belt end through the pouch. The preferred embodiment utilizes "VELCRO" hook and loop type fastening material on the pouch and adjacent gown area, but snaps, adhesives, or other releasable pressure sensitive holding elements could be used.

The arrangement of the invention is extremely effective and convenient, and eliminates excessive strain, and it is still simple and inexpensive to manufacture and package. It is particularly useful in side belted gown constructions like those of the said Horan applications, but could obviously be used in other types of gowns. Various other features, objects and advantages will be apparent from the description to follow.

BRIEF DESCRIPTION OF THE DRAWINGS

FIG. 3 is an enlarged view in cross section through the plane 3—3 shown in FIG. 2, but in which an inner tie has been completed;

FIG. 4 is an enlarged view in cross section through the plane 4—4 shown in FIG. 1;

FIG. 5 is a further enlarged fragmentary view, partially broken away, showing the back belt member in its storage pocket; and FIG. 6 is a view in cross section through the plane 6—6 shown in FIG. 5.

DESCRIPTION OF THE PREFERRED EMBODIMENTS

Figure 1:
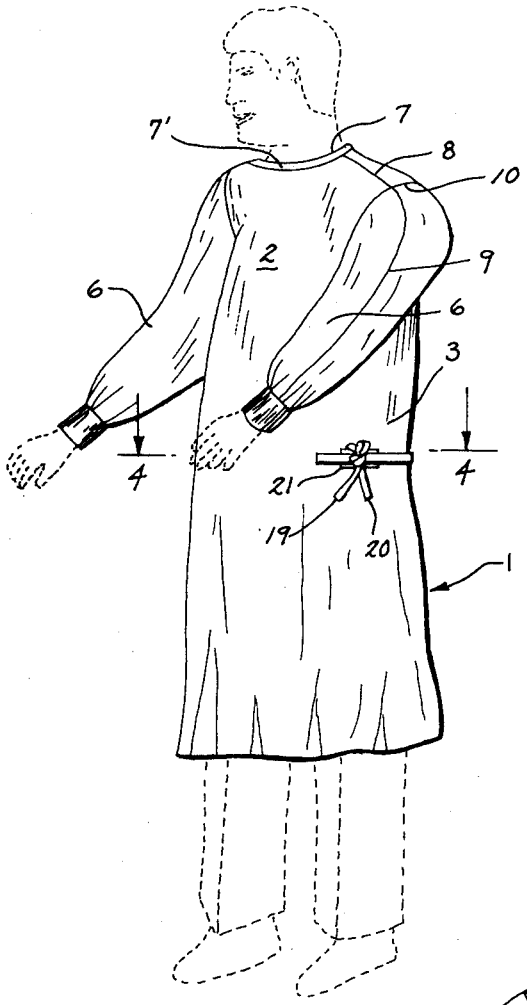
FIG. 1 is a schematic view in perspective showing a preferred embodiment of the invention, the gown being shown fully closed.

The gown in the drawings is designated generally by the reference numeral 1. It is of conventional overall configuration, including a front portion 2, a left side portion 3, a right side portion 4, a back portion 5, cuffed sleeves 6 and a taped neck opening 7. The gown 1 is preferably made of a suitable disposable paper material, although it may be made of cloth or other materials. The body of the gown 1 as shown is cut from a single piece of material so that there are only two seams 8 running from the neck opening 7 to opposite sleeves 6. The sleeves 6 have single outside seams 9 and are stitched to the gown body along the armhole line 10. While this construction is preferred, other known configurations are obviously possible, such as separate panels stitched together to form the body.

Figure 2:
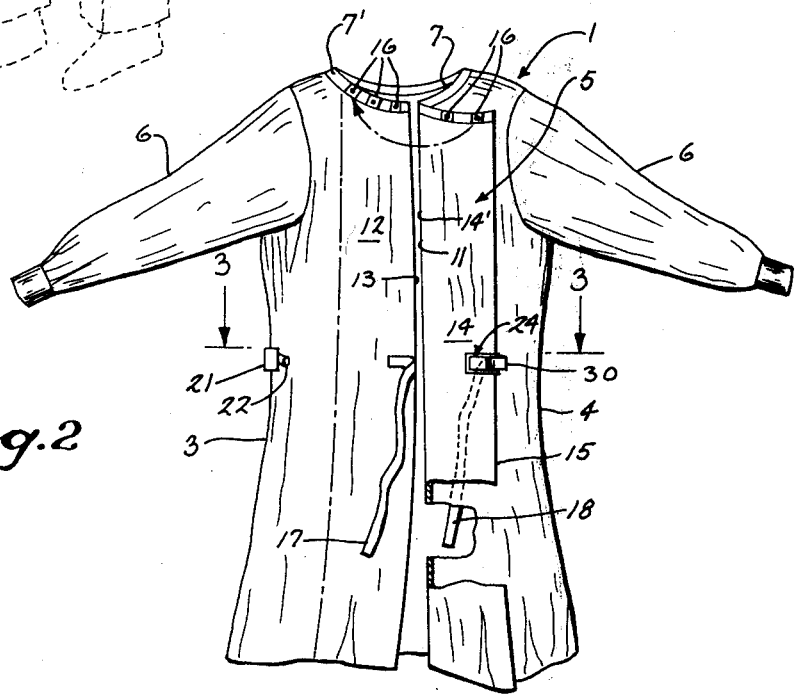
FIG. 2 is a back view, partially broken away, of the gown of FIG. 1, but showing the gown in an open condition.

Referring to FIG. 2, there is a vertical back opening line 11 running down approximately the middle of the back section 5 from top to bottom. The portion of the back 5 to the left of the line 11 as seen in FIG. 2 constitutes an inner back panel 12, and it has a free edge 13 parallel to and at the opening line 11. The right hand portion of the back panel as seen in FIG. 2 constitutes a closure panel 14 that is shown in an open position in which it is folded back on itself along a vertical fold line 14' that is also at and parallel to the line 11, the panel 14 having a free vertical edge 15. When the closure panel 14 is unfolded in the direction of the arrow as seen in FIG. 2, it moves to a closed position seen in FIG. 4 in which it extends across the opening line 11 and overlaps the panel 12, and its free edge 15 is toward the left side of the gown. This folded configuration is conventional for a sterile back gown; the facing surfaces of the folded panel 14 remain sterile during donning and, when unfolded, will provide a sterile surface across the back of the gown. As will be apparent, however, the invention may be used with other gown configurations.

Conventional snap closure members 16 are provided along the neck opening 7, the respective snap parts being on the outer surface of the panel 12 and what is the inner surface of the panel 14 when the gown is closed, and there are preferably a series of snaps 16 to allow the neck opening to be properly fitted to the user. As previously indicated, there is reinforcing tape 7' around the opening 7, and the snaps 16 are attached through the tape for added strength. The neck closure is made in conventional fashion by a non-sterile assistant; the neck area is generally accepted as being non-sterile for purposes of sterile back gown donning techniques.

The preferred embodiment includes an inner, waist-high tie closure in addition to the outer belt closure to be described. The tie closure comprises a first inner tie member 17 that has one of its ends glued or otherwise attached to the panel 12 at the edge 13 to be on the inner back panel side of the line 11. A second inner tie member 18 has one end attached to the inner surface of the gown at a point that is on the closure panel side of the line 11 near the free edge 15 when the panel 14 is folded. The members 17 and 18 can be tied together in conventional fashion to provide the inner closure as seen in FIGS. 3 and 4. This inner closure can be made by a non-sterile assistant before the panel 14 is unfolded, and this does not affect sterility since the sterile surface of the panel 14 will ultimately be over the inner closure.

After the neck and inner tie closures have been made, final closure of the gown 1 is made by means of a first or side belt member 19 and a back belt member 20, both of which are at approximately waist level and connected to parts of the gown as will be described. The belt members 19 and 20 are tied or connected at a point on the side of the gown — the left side in the preferred embodiment — with no substantial portion of the belting extending across the front portion 2. This side belted arrangement is preferred since it eliminates the bunching and other disadvantages of a front belt, but the back belt arrangement of this invention may, as previously noted, be used with various belt arrangements.

The side belt 19 is, before closure, substantially encased and withdrawably store in a horizontally oriented storage sleeve 21 on the side of the gown 1 at waist level, the sleeve 21 being open at both its forward and rear ends. The sleeve 21 is seen most clearly in FIGS. 3 and 4 and may be created very simply by gluing, stitching or otherwise adhering the upper and lower horizontal edges of a rectangular piece of material, preferably the same as the gown material, to the side portion 3. The belt 19 and the belt 20 are also preferably made of the same material as the gown, and may be longitudinally folded and glued or stitched to give increased strength if desired.

One end of the belt 19 is glued or otherwise attached to the gown 1 at an area immediately forward of the sleeve 21. As can be seen in FIG. 3, the belt 19 has a portion that extends horizontally rearwardly through and beyond the open rear end of the sleeve 21 where it is doubled back on itself to define a loop 22 that projects through the open rear end of the sleeve 21. The ribbon-like material of the belt 19 is preferably also twist folded at the loop 22 as shown to make the loop 22 more visible and easier to grasp. From the loop 22, the belt 19 returns forwardly through the sleeve 21 to present a free end 23 that projects through the open forward end of the sleeve 21.

As can be seen most clearly in FIGS. 3, 5 and 6, the back belt 20 is withdrawably stored, before closure, in a pocket 24 that is formed by attaching the upper, lower and left edges, as seen in FIG. 6, of a rectangular piece of material, like that of the gown 1, to what is after full closure the inner surface of the panel 14, the pocket 24 having an open end 25 that is parallel to and approximately at the edge 15. The belt 20 is similar to the belt 19, and its fixed end is glued or otherwise attached to the panel 14 in the area covered by the pocket 24 as seen in FIG. 5. The belt 20 is folded upon itself as many times as may be necessary so that the bulk of its length is retained within the pocket 24 and only a relatively short portion of the free end 26 extends outwardly. The free end 26 is encased in an open-ended protective pouch 27 that is generally rectangular and is closed on three sides. The pouch 27 preferably includes a relatively stiff, foldable backing sheet 28 of paper, foil or other suitable material, and a transparent cover sheet 29 of suitable plastic film that is heat sealed or otherwise attached to the backing sheet 28 along three sides to define the pouch 27. As can be seen in FIG. 6, the open end portion of the pouch 27 extends substantially horizontally into the pocket 24. The remainder extends laterally beyond the free edge 15 of the closure panel to define a holding portion 30 that overlies and faces an adjacent portion of the right side 4 of the gown. At the end of the portion 30, the pouch 28 is deadfolded back on itself along a line 31 to define a tab portion 32 that extends back toward the closure panel. As seen in FIG. 5, the tab portion 32 contains the free end 26 of the belt 20. Pressure sensitive fastening means 33 is interposed between the holding portion 30 and the facing gown material.

The fastening means 33 is preferably of the type in which one component is a female member 33a while the other component is a male member 33b adapted to engage and be retained by the female component. Especially preferred is the VELCRO type fastening material in which the female components or strips are comprised of a backing having a plurality of outwardly extending fiber or filament loops eminating from the backing layer, and the male component is comprised of segments having a backing layer and a plurality of relatively stiff, fiber-like, outwardly extending male hook members. The male members are adapted to engage and be retained by the loops of the female strips, but may be pulled free of the loops without excessive force. The male members may be elongated rod-like elements having various hooks or beads at their outer ends. While in the drawings the female component is shown attached to the gown and the male component is attached to the pouch, it is apparent that the arrangement could be reversed. Other pressure sensitive fastening means such as snaps, tapes, or adhesives, could, of course, be substituted.

It is important that the tab-like portion 32 of the pouch 27 remain relatively flat against the outer surface of the pocket 24, as opposed to relaxing and unfolding in a counterclockwise direction to a point where it is over or nearer the adjacent sterile portion of the panel 5, since if such unfolding occurs the assistant's hand may touch or come too close to the sterile portion when the pouch is grasped. The deadfold prevents this, the term "deadfold" being intended to cover suitable permanent or stable fold in which there is no significant tendency to unfold. Achieving the desired deadfold may require higher pressure and/or heat during the folding operation depending on the materials used, but the necessary techniques will be apparent to those skilled in the art.

The pouch 27 is arranged so that its outer or exposed surface when the panel is in the position of FIG. 2, is the nontransparent backing sheet 28. Thus, when the pouch 27 is folded back to form the tab 32, the free end of the belt 26 can be seen through the transparent back 29 of the pouch and the assistant will be able to be sure of grasping it through the pouch 27.

When the gown 1 is first donned, it will appear from the back as seen in FIG. 2. That is, the panel 14 will be held in its folded, open position to the right by the pouch 27 which is attached by fastening means 33 to the gown, the belt 19 will be in the sleeve 21, and the belt 20 will be in the pocket 24 with its free end 26 in the pouch 27 but visible in the tab portion 32 as described above. The belt 20 will be retained in its pocket 24 by having a substantial portion of the open end of the pouch 26 extend into the pocket 24 and the pouch will be anchored to the gown 1 by the fastening means 33. The entire gown 1 will have been presterilized, and to this point will have remained completely sterile, assuming it is donned with generally accepted sterile gown donning techniques. A non-sterile assistant can then make the neck closure and inside ties as described above.

After the neck and inside closures have been made, the assistant can grasp the tab 32 of the pouch 27, and with it the free end 26 of the belt 20; as previously noted, having a substantial portion of the pouch 26 extend into the pocket 24 and a holding portion 30 extend outside the pocket which is anchored to the gown by fastening means 33 and deadfolded to form the tab 32 is very important since it insures that the pouch 27 and the tab 32 will be in the position shown in FIG. 6, which means that the assistant's hand need not contact a surface that is to remain sterile. The transparent sheet 29 is also important since the assistant will be able to see that he is actually grasping the free end of the belt 26. The assistant will then pull the tab outwardly to release the fastening means 33. Once the pouch 27 has been released from attachment with the gown, the assistant can close the panel 14 by using the pouch 27 as a handle and then partially withdraw the belt 20 from the pocket 24 and pass the belt 20 around to the left as seen in FIG. 2 to the point where it can be reached by the wearer. The wearer will grasp the belt 20 immediately behind the pouch 27, and the assistant can then simple pull the pouch 27 off the free end 26 of the belt, leaving the wearer with a completely sterile back belt section.

Before or after he receives the belt 20, the wearer can grasp the free end 23 of the belt 19 and pull it forwardly to remove it from the sleeve 21. He can then pull it rearwardly and tie it to the belt 20.

The loop 22 is not used when closure is made in the sterile fashion described above — the material of the loop is simply pulled through the sleeve 21 by the wearer. The loop 22 is, however, very important in that it allows for non-sterile closure by an assistant in those cases where a sterile back is not necessary. That is, the assistant can simply grasp the belt 19 at the loop 22 and pull the material rearwardly through and out of the sleeve 21 and tie it to the belt 20, the folded configuration of the loop 22 making it easier to grasp for this purpose. If there were no loop extending out the rear of the sleeve 21, it would be necessary for the assistant to reach around the side of the wearer and grasp the free end 23, which would raise the possibility of contamination of the sterile side and front areas of the gown 1.

The preferred embodiment of the invention shown and described is highly effective, but it will be obvious that various modifications might be made without departure from the spirit of the invention. The invention may, for example, be useful for garments other than surgical gowns. Furthermore, different methods of attachment, materials and specific configurations might be substituted in the specific belts shown; and the back belt shown might be used with a different or conventional side or front belt. In view of the possible modifications, the invention is not intended to be limited by the showing or description herein, or in any other manner, except insofar as may specifically be required.

I claim:

1. In a sterile back surgical gown of the type in which there is a vertical back opening line, an inner back panel with a free edge parallel to the opening line, a closure panel having an open position wherein it is folded back on itself along a fold line parallel to the opening line with its free vertical edge toward one side of the gown, the closure panel being movable to an unfolded closed position wherein it extends across the opening line and overlaps the inner back panel with its free edge toward the other side of the gown to provide a sterile back for the gown, a first belt having a fixed end attached to the gown on said other side and forwardly of the free edge of the closure panel when the closure panel is in its closed position and a free end, a back belt that is tyable to the first belt and has a fixed end attached to the closure panel and a free end, a pocket on the closure panel that has an open end, the fixed end of the back belt being attached to the closure panel in the area covered by the pocket, the back belt being withdrawably stored in the pocket with only its free end protruding from the open end, and an elongated protective pouch having an open end and a closed end removably covering the free end of the back belt, said pouch having a portion including the open end thereof extending into said pocket, the improvement wherein: the pouch extends laterally beyond the free edge of the closure panel to define a holding portion facing an adjacent portion of said one side of the gown; and there is a releasable fastening means between the holding portion and adjacent gown portion.

2. A gown according to claim 1 wherein: the portion of the pouch beyond the holding portion is folded back upon itself to form a tab; and the free end of the belt extends into the tab.

3. A gown according to claim 1 wherein: the tab has a transparent wall section through which the free end of the belt can be seen.

4. A gown according to claim 1 wherein: the fastening means comprises a female member and a mating male member, one of said members being attached to the gown proper and the other being attached to the pouch.

5. In a sterile back surgical gown of the back opening type in which there is a back closure panel which is maintained prior to donning in an open folded position and which after the gown is donned is unfolded to a closed position in which it overlaps the back of the gown and provides a sterile back for the gown and a belt closure system which comprises in part a back belt which is attached at one end to the back closure panel and stored in a pocket thereon, the improved means of maintaining said back closure panel in a folded position and protecting the free end of said back belt from contamination which comprises an elongated protective pouch for the free end of said back belt, said pouch having a first portion extending into the pocket and a second portion containing the free end of the belt and extending out of said pocket across the fold line of said back closure panel and over a portion of the gown proper, said second portion being provided with pressure sensitive means for releasably attaching said pouch to the gown proper to maintain the back closure panel in an open folded position and anchoring the free end of the belt until the gown has been donned.

* * * * *